United States Patent [19]

Baguelin

[11] Patent Number: 4,492,192

[45] Date of Patent: Jan. 8, 1985

[54] DIESEL PISTON ENGINE

[75] Inventor: Yves Baguelin, Rhone, France

[73] Assignee: Renault Vehicules Industriels, France

[21] Appl. No.: 518,434

[22] Filed: Jul. 29, 1983

[51] Int. Cl.[3] ..... F02D 13/04; F02D 17/02

[52] U.S. Cl. ..... 123/198 F; 123/2; 123/DIG. 7; 60/712

[58] Field of Search ..... 123/198 F, 2, DIG. 7; 60/712

[56] References Cited

U.S. PATENT DOCUMENTS

| | | | |
|---|---|---|---|
| 1,013,528 | 1/1912 | Broderick | 123/198 F |
| 1,409,625 | 3/1922 | Vosbrink | 123/198 F |
| 1,804,873 | 5/1931 | Hoffman | 123/2 |
| 3,365,014 | 1/1968 | Clingerman et al. | 123/198 C |
| 3,744,934 | 7/1973 | Veno | 123/198 F |
| 3,958,900 | 5/1976 | Veno | 123/DIG. 7 |
| 3,963,379 | 6/1976 | Veno | 123/DIG. 7 |
| 4,211,083 | 7/1980 | Veno | 123/198 F |

FOREIGN PATENT DOCUMENTS

| | | | |
|---|---|---|---|
| 197811 | 11/1978 | Fed. Rep. of Germany | 123/198 F |

*Primary Examiner*—Ira S. Lazarus

*Attorney, Agent, or Firm*—Remy J. VanOphem

[57] ABSTRACT

A diesel piston engine having at least one modified cylinder adapted for use as an engine cylinder or as a compressor cylinder. The modified cylinder has an extra valve, a biasing member biasing the extra valve closed, and hydraulic means for controlling the sequential opening of the extra valve. The modified cylinder further includes a switching device for alternately disconnecting the hydraulic means and permitting normal fuel injection or connecting the hydraulic means and preventing normal fuel injection.

20 Claims, 2 Drawing Figures

DIESEL PISTON ENGINE

BACKGROUND OF THE INVENTION

The present invention relates to a diesel piston engine of a novel type, at least one cylinder of which may be used, as desired, sometimes as an engine cylinder, and at other times as an air compressor cylinder. Such a device is provided, more particularly, though not exclusively, for the diesel engine of a vehicle, such as a truck or a bus.

It is known that in vehicles of this type, it is necessary to provide an effect called "braking with the motor" to insure the engine's restraint during the phases of deceleration or during operation on downhill grades. During these deceleration phases, the driver operates the braking system, which in heavy trucks is precisely the main consumer of compressed air. This compressed air is generally supplied by an auxiliary pistion compressor which is mechanically coupled with the motor. It is clear that, apart from the periods when this compressor is delivering compressed air to the braking system for decleration, that is, most of the time, the energy consumed for keeping the compressor rotating is wasted and therefore decreases the efficiency of the vehicle.

An attempt has been made to improve this situation by incorporating into the engine one or more cylinders capable of insuring the operation of the compressor, or at least, an operation increasing the effect of braking with the motor.

A first solution, described for example in U.S. Pat. No. 1,804,873, consists in using a single cylinder block in which certain cylinders are engine cylinders, while others operate as a compressor. The disadvantages of this system are twofold. The compressor cylinders are specialized and may never be used as engine cylinders. Furthermore, a loss of energy exists due to rotation of the mobile coupling of the compressor cylinders, even when this is not necessary.

Another solution, described for example in U.S. Pat. No. 3,365,014, consists in provisionally modifying the distribution principle in only certain cylinders of a diesel motor, the operation of which may at will be either that of an engine cylinder or a compressor cylinder. The disadvantage of prior art engines of this type is that the cylinders are identical to one another. Thus the output obtained is very mediocre when operating as compressor or for restraining the vehicle. Moreover, it is found that, although this system makes it possible to restrain the vehicle in going downhill, it is insufficient to constitute a real source of compressed air, and particularly is insufficient to adequately refill the compressed air storage cylinders.

SUMMARY OF THE PRESENT INVENTION

The present invention has the aim of avoiding these disadvantages by making a diesel piston engine in which at least one cylinder will be capable of operating, as desired, and in a reversible manner, either as an engine cylinder, or as a compressor cylinder with a sufficient output to permit feeding the compressed air storage cylinders.

A diesel piston engine according to the present invention includes a number of engine cylinders, the distribution of which is insured by intake and exhaust valves controlled by rocker levers and at least one camshaft, while an injector fed with fuel oil injects into each cylinder the amount of fuel oil necessary for combustion. A diesel piston engine according to the present invention is further characterized in that at least one of these engine cylinders is adapted for use as a compressor. The modified cylinder is provided with an extra valve, a spring for restoring the extra valve to its closed position, hydraulic means for controlling the sequential opening of the extra valve in synchronism with the cycle of operation of the other engine cylinders and selectively controllable switching means for alternatively disconnecting the hydraulic means and allowing the injection of fuel oil to occur normally into the manifold cylinder, which then operates as an engine cylinder or connecting the hydraulic means and preventing the injection of fuel oil into the manifold engine cylinder, which then operates as an air compressor cylinder.

In an exemplary embodiment of the present invention, the hydraulic means includes a master cylinder cooperating with a distribution rocker lever of another cylinder of the diesel piston engine, and a regulated piston-cylinder unit constituting a thrust jack acting on the rod of the extra valve.

In the preferred embodiment of the present invention, at least one inlet valve of a modified cylinder is connected by hydraulic intake means to one of the cams of the distribution camshaft of the diesel piston engine for opening this intake valve during all or part of the period of time which would be the combustion time if this modified cylinder were operating as an engine cylinder. The starting of operation of the hydraulic intake means is determined by switching means when the switching means are in a position for the modified cylinder to operate as a compressor cylinder.

BRIEF DESCRIPTION OF THE DRAWINGS

The attached drawings, given as a nonlimiting example, will make it possible to better understand the invention and the advantages which it is capable of providing. In the drawings.

DETAILED DESCRIPTION OF THE PREFERRED EMBODIMENT

Figure 1:
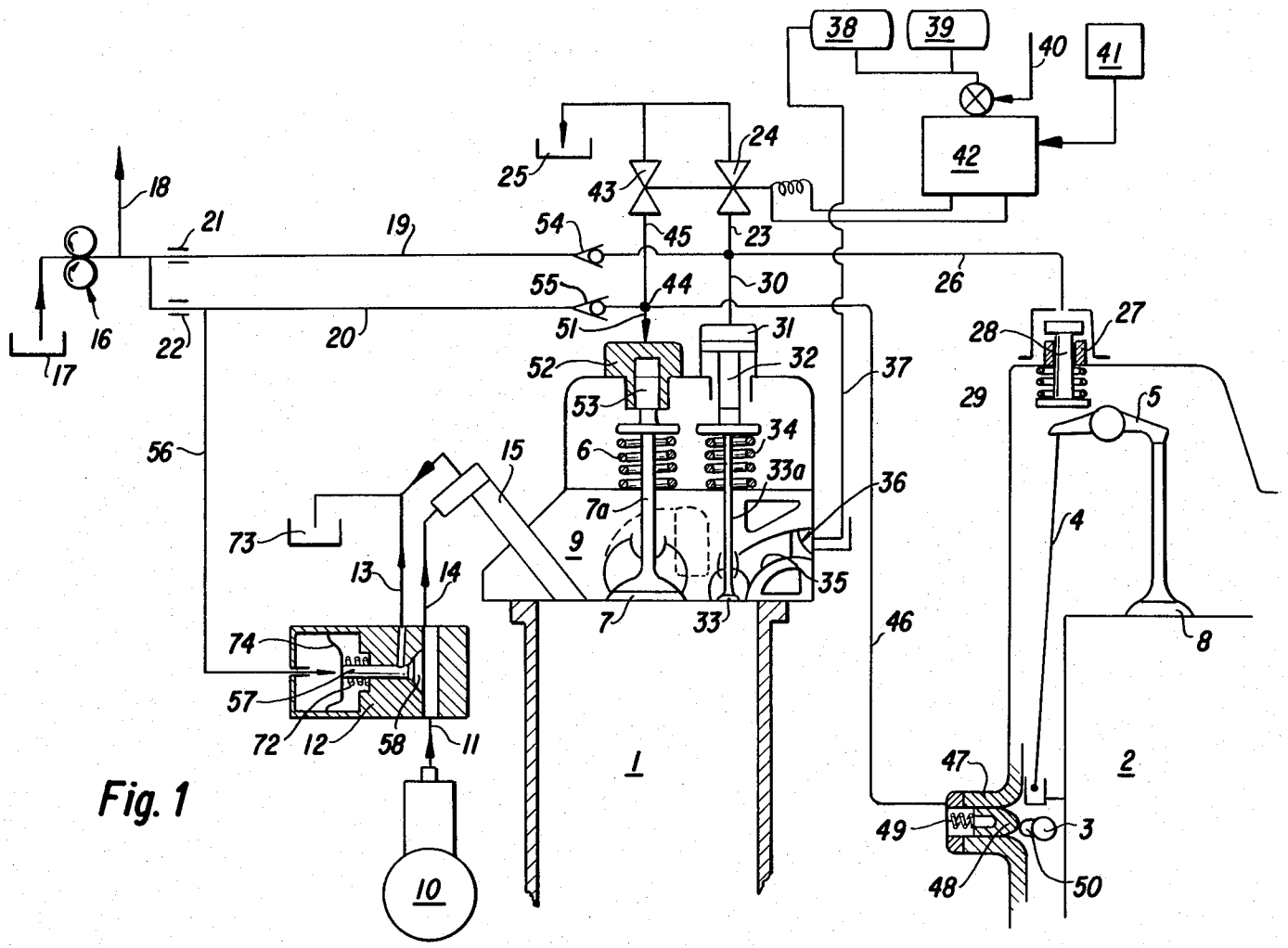
FIG. 1 is an axial sectional view showing diagrammatically two cylinders of the same diesel piston engine according to the present invention.

In the drawings a modified cylinder 1 and an engine cylinder 2 of the same diesel piston engine have been represented. The distribution is insured in a known manner by means of a camshaft 3 which operates push rods 4 and rocker levers 5 for selective opening of the intake valves 7 and 8, respectively, and exhaust valves, not represented in the drawing, of the modified cylinder 1 and the engine cylinder 2. The intake and exhaust valves normally maintained seated in the cylinder head 9 by means of biasing means such as a spring 6.

An injection pump 10 sends fuel oil, premeasured and under high pressure, into a fuel oil injection line 11 which may be alternatively connected by a manifold 12 to a return line 13 which is connected to a fuel oil tank 73, or to a line 14 which is connected to an injector 15.

An oil pump 16 draws off lubricating oil in a storage pan 17 for feeding the main lubrication line 18 of the diesel piston engine.

According to the present invention, two hydraulic lines 19 and 20, each provided with a starting choke 21 and 22, respectively are connected to the oil pump 16 in parallel with the main lubrication line 18.

The hydraulic line 19 is divided into three lines 23, 26 and 30. An electromagnetic valve 24 is provided along the line 23 to selectively connect the line 19 to a return reservoir 25. The line 26 opens into a transmitting cylinder or master cylinder 27. The piston 28 of the master cylinder 27 is biased by a spring 29 to lie against the shoulder of the rocker lever 5. The line 30 opens into a receiving cylinder or regulated cylinder 31. The piston 32 of the regulated cylinder 31 is in contact with the end of the rod 33*a* of an extra valve 33 which is provided in the cylinder head 9 for opening into the combustion chamber of the modified cylinder 1. A restoring spring 34 keeps the valve 33 closed as long as the hydraulic pressure in the receiving cylinder 31 does not move it against the setting force of the restoring spring 34.

Downstream from the extra valve 33, the cylinder head 9 is provided with a delivery line 35 on which is inserted a check valve 36. A line 37 connects the check valve 36 to two reservoirs 38 and 39 for storing compressed air.

A pressure detector 40 is sensitive to the air pressure in the reservoirs 38 and 39. It cooperates with a deceleration detector 41, which is sensitive to the intensity of deceleration of the vehicle, to control a release 42 which opens or closes the electromagnetic valve 24 and another electromagnetic valve 43, described later, to which it is coupled.

At the point 44, the line 20 is divided into three lines 45, 46, and 47. The line 45 is connected to the electromagnetic valve 43. The line 46 is connected to a transmitting cylinder 47 the piston 48 of which is biased by its spring 49 into contact with one of the cams 50 of the camshaft 3. The 51 opens into a receiving cylinder 52, the piston 53 of which is pushed back by hydraulic pressure against the end of the rod 7*a* of the intake valve 7.

Check valves 54 and 55 are provided on each of the lines 19 and 20 upstream of the locations where the lines are divided into the lines 23, 26 and 30 and the lines 45, 46, and 51.

The manifold 12 includes a distributing valve 58 held on its seat by a spring 72 and by the pressure of the fuel oil in the fuel oil injection line 11. In its open position, the distributing valve 58 diverts the fuel oil through the line 13 toward the reservoir 73. The distributing valve 58 is integral with the central part of a flexible and tightly sealed diaphragm 74. The diaphragm is subjected to the pressure of a line 56 which is interconnected with the line 20 immediately downstream from its choke 22 and upstream of the check valve 55. The line 56 opens into the manifold 12 to operate the piston 57 of its distributing valve 58.

The operation of the present invention will now be described.

During the normal operation of the vehicle, the pressure in the reservoirs 38 and 39 is at its maximum level, and the detector 40 detects no deceleration. In this case, the electromagnetic valves 24 and 43 remain open; the springs 6, 29 and 34 balance the hydraulic pressure in the cylinders 52, 27, and 31, respectively. The modified cylinder 1 then operates in the normal manner of a diesel engine cylinder.

If the vehicle decelerates, however, and if the level of the air pressure happens to drop in the reservoirs 38 and 39 to below a predetermined threshold level, then the release 42 closes the two electromagnetic valves 24 and 43. The lines 26, 30, 46, 51 and 56 each experience an increase in pressure.

The increased pressure in the line 56 causes the opening of the valve 58, which connects the fuel oil injection line 11 and the return line 13 so that any further injection by the injector 15 is prevented. The flow of fuel oil from the injection pump 10 is diverted to the fuel oil tank 73.

With each rocking cycle of the rocker lever 5, the extra valve 33 opens once. The timing of the opening of the extra valve 33 is chosen so that the piston of the modified cylinder 1 delivers pressurized air through the check valve 36 to the reservoirs 38 and 39.

With each movement of the piston 48 with the passage of the high point of the cam 50, the intake valve 7 is slightly opened. The timing of the opening of the intake valve 7 is selected such that the timing corresponds to the power stroke for the piston of the modified cylinder 1 so as to prevent the power stroke of the piston from creating a reduced pressure in the modified cylinder 1, and thus running the risk of drawing up oil into the cylinder.

This loosening of the intake valve 7 is a preferred but not essential feature of the present invention.

Figure 2:
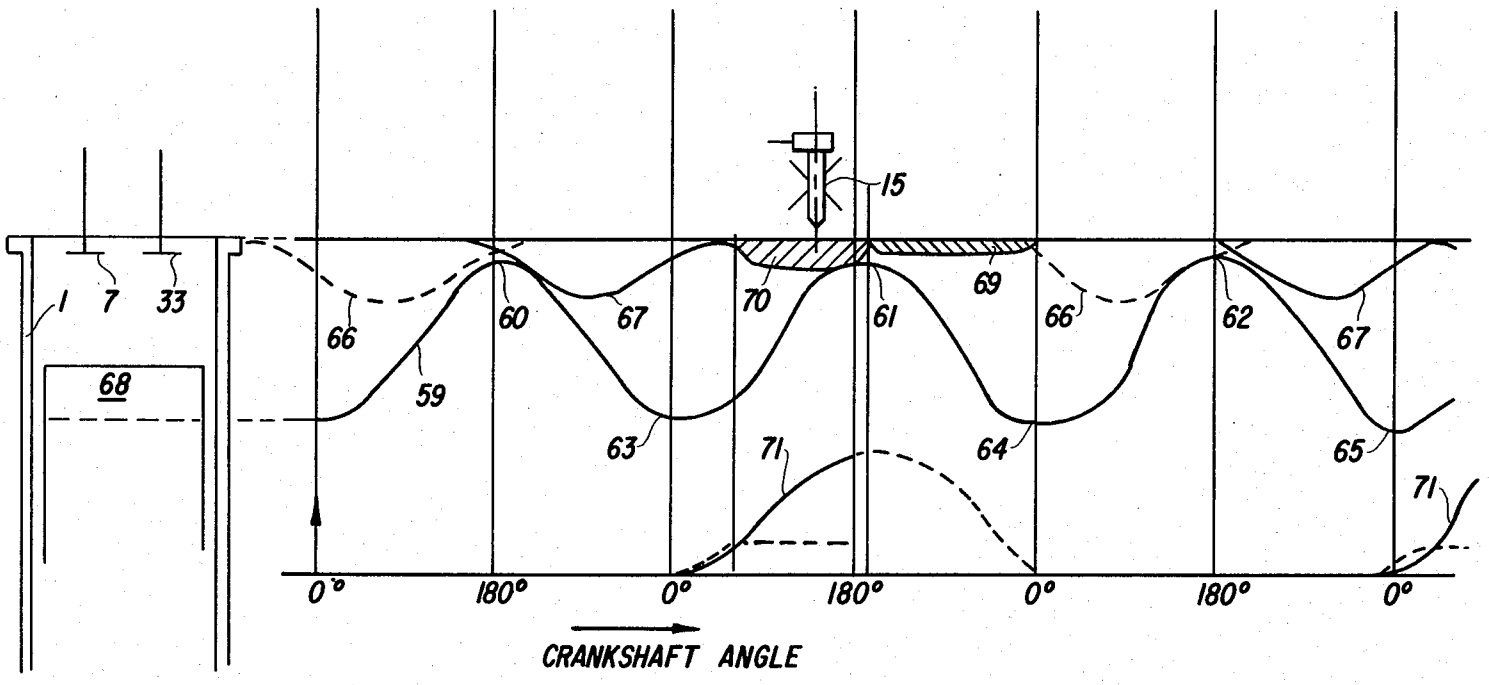
FIG. 2 is a schematic section view of a modified cylinder of the diesel piston engine of FIG. 1 and a graphical representation showing a number of parameters of cyclical operation of the modified cylinder as an engine cylinder and a compressor cylinder.

FIG. 2 graphically represents the principles and the order of operation of the various elements according to the present invention. On the abscissa is plotted, in degrees, the angle of rotation of the crankshaft of the diesel engine.

The curve 59 illustrates the motion of the main piston 68 of the modified cylinder 1, which moves alternatingly between the top dead center points such as 60, 61 and 62 and the lower dead center points such as 63, 64 and 65.

The curve 66 illustrates the known opening and closing motion of the exhaust valve of the modified cylinder 1.

The curve 67 illustrates the opening and closing motion of the intake valve 7. According to the preferred modification of the invention, the loosening of the intake valve 7 takes place according to the arc of the curve 69, after the top dead center 61 where the injection of fuel oil would ordinarily have occurred.

The injector 15 is illustrated at the time that injection would occur when the modified cylinder 1 is being used as an engine cylinder.

The curve 70 illustrates the motion of the extra valve 33 which opens at the end of compression before the top dead center 61.

The curve 71 shows the trend of the compressed air pressure inside the modified cylinder 1. It is seen there that the modified cylinder 1 delivers compressed air during the period between the dead center points 63 and 61, that is, once for every two rotations of the crankshaft, during a phase of recovery of energy and of deceleration of the vehicle.

It will be readily apparent that the present invention has several advantages over the prior art. The present invention is compatible with the installation and operation of any known system of braking with the motor which acts to open the exhaust valves at the end of compression, at least with the cylinders not involved in the production of compressed air. When the production of compressed air is not used, the present invention eliminates any loss of energy related to the driving of compressor elements. Finally, the present invention makes it possible not only to restrain the vehicle by the production of compressed air, but also to recover and store this compressed air, as compared with prior art systems which simply discharge the compressed air into the motor exhaust.

Having thus described the present invention by way of a detailed example of structure, modifications and variations therefrom will be apparent to those skilled in the art. Such modifications are included within the intended scope of the claims appended hereto.

What is claimed as novel is as follows:

1. In a diesel piston engine, comprising a plurality of cylinders, a cylinder head for each of said plurality of cylinders, intake valve means and exhaust valve means for each of said plurality of cylinders, a fuel oil injector for each of said plurality of cylinders, control means selectively operable to enable and disable said fuel oil injectors, and timing means for regulating the cycle of operation of said plurality of cylinders, said intake valve means, said exhaust valve means and said fuel oil injectors, the improvement wherein a preselected cylinder of said plurality of cylinders further comprises:

passage means in said cylinder head of said preselected cylinder having one end opening into said preselected cylinder;

extra valve means along said passage means for selectively opening and closing said passage means;

hydraulic means for controlling the sequential opening and closing of said extra valve means in synchronism with the cycle of the other cylinders of said plurality of cylinders; and switching means selectively operable to disconnect and connect said hydraulic means and to enable and disable said fuel oil injector such that said switching means disconnects said hydraulic means and enables said fuel oil injector to operate said preselected cylinder as an engine cylinder and further such that said switching means connects said hydraulic means and disables said fuel oil injector to operate said preselected cylinder as a compressor cylinder.

2. The improvement of claim 1 wherein said hydraulic means further comprises:

a transmitting cylinder having a piston controlled by said timing means to selectively pressurize fluid in said transmitting cylinder during the period of time in said cycle of operation when combustion would have occurred in said preselected cylinder if said fuel oil injector is enabled; and receiving cylinder means hydraulically interconnected to said transmitting cylinder and mechanically interconnected with said extra valve means such as to selectively operate said extra valve means in response to the pressure level generated by said transmitting cylinder.

3. The improvement of claim 2 wherein said timing means further comprises rocker lever means for regulating the operation of each of said intake valve means, said piston of said transmitting cylinder being mechanically interconnected wth said rocker lever means of one of said other cylinders.

4. The improvement of claim 1 further comprising means for selectively opening said intake valve means of said preselected cylinder when said switching means connects said hydraulic means during the phase of said cycle of operation when combustion would occur in said preselected cylinder if said fuel oil injector were enabled.

5. The improvement of claim 1 further comprising:

hydraulic pump means;

control cylinder means interconnected with said intake valve means of said preselected cylinder such as to selectively open said intake valve means in response to a predetermined pressure level;

a first hydraulic line interconnecting said hydraulic pump means and said control cylinder means;

fuel oil pump means;

a fuel oil injection line interconnecting said fuel oil pump means and said fuel oil injector;

manifold valve means along said fuel oil injection line selectively operable to divert said fuel oil from said fuel oil pump means from said fuel oil injector; and a second hydraulic line interconnecting said first hydraulic line and said manifold valve means such that said manifold valve means selectively disables and enables said fuel oil injector in respnse to the pressure level in said second hydraulic line.

6. The improvement of claim 5 further comprising:

a third hydraulic line interconnecting a portion of said first hydraulic line between said third hydraulic line and said control cylinder means with a low pressure sink; and first valve means disposed along said third hydraulic line and selectively operable to close said third hydraulic line in response to said switching means such that the pressure level in said first and said second hydraulic lines increases when said first valve means is closed, thereby actuating said manifold valve means to disable said fuel oil injector.

7. The improvement of claim 6 further comprising:

a check valve disposed along said first hydraulic line between said second hydraulic line and said third hydraulic line;

a transmitting cylinder having a piston controlled by said timing means to selectively pressurize hydraulic fluid therein during the period of time in said cycle of operation when combustion would occur in said preselected cylinder if said fuel oil injector is enabled; and a fourth hydraulic line interconnecting said transmitting cylinder and said control cylinder means such that, when said first valve means is closed, said intake valve means of said preselected cylinder is selectively opened in response to an increased pressure level in said transmitting cylinder.

8. The improvement of claim 1 further comprising:

hydraulic pump means;

fuel oil pump means;

manifold valve means having a first inlet, a second inlet, a first outlet, and a second outlet, said manifold valve means being selectively operable to interconnect said first inlet with said first outlet and to interconnect said first inlet with said second outlet in response to the pressure level at said second inlet;

low pressure hydraulic sink means;

low pressure fuel oil sink means;

a first fuel oil line interconnecting said fuel oil pump means with said first inlet of said manifold valve means;

a second fuel oil line interconnecting said fuel oil injector with said first outlet of said manifold valve means;

a third fuel oil line interconnecting said low pressure fuel oil sink means with said second outlet of said manifold valve means;

a first hydraulic line interconnecting said hydraulic pump means with said low pressure hydraulic sink means;

first valve means along said first hydraulic line for selectively dosing said first hydraulic line in response to said switching means; and a second hydraulic line interconnecting said second inlet of said manifold valve means with a portion of said first hydraulic line between said hydraulic pump means and said first valve means such that, when said switching means opens said first valve means, the pressure at said second inlet is low and said manifold valve means interconnects said first inlet with said first outlet, thereby enabling said fuel oil injector, and when said switching means closes said first valve means, the pressure at said second inlet is high and said manifold valve means disconnects said fuel oil injector from said fuel oil pump means and disables said fuel oil injector.

9. The improvement of claim 1 further comprising:

a compressed air reservoir;

a pressure detector measuring the pressure level in said compressed air reservoir and generating a first signal in response to said pressure level being measured below a predetermined minimum pressure level, said switching means disabling said fuel oil injector of said preselected cylinder and connecting said hydraulic means in response to said first signal; and an air line interconnecting said passage means and said compressed air reservoir.

10. The improvement of claim 9 further comprising check valve means disposed along said air line such that air may flow therealong only in the direction from said preselected cylinder to said compressed air reservoir.

11. The improvement of claim 9 further comprising deceleration detection means responsive to the motion of a vehicle containing said diesel piston engine, said deceleration detection means generating a second signal in response to the deceleration of said vehicle exceeding a predetermined level, said switching means responding to said first signal only when said second signal is generated.

12. The improvement of claim 1 wherein said hydraulic means for controlling the opening and closing of said extra valve means comprises:

sending cylinder means responsive to said timing means to generate an increased pressure level therein during the period of time in said cycle of operation when fuel oil would be injected into said preselected cylinder if said fuel oil injector is disabled; and receiving cylinder means responsive to said pressure level generated by said sending cylinder means to selectively operate said extra valve means in response to said pressure level exceeding a predetermined pressure level.

13. The improvement of claim 12 wherein said switching mean comprises:

pressure exhaust means interposed said sending cylinder means and said receiving cylinder means to exhaust said pressure generated by said sending cylinder means; and valve means disposed along said pressure exhaust means and selectively operable to open and close said pressure exhaust means.

14. In a diesel piston engine comprising a plurality of cylinders, a cylinder head for each of said plurality of cylinders, intake and exhaust valve means for each of said plurality of cylinders, a fuel oil injector for each of said plurality of cylinders, a compressed air reservoir, low pressure fuel oil sink means, low pressure hydraulic sink means, and timing means for regulating the cycle of operation of said plurality of cylinders, said intake valve means, said exhaust valve means, and said fuel oil injectors, the improvement wherein a preselected cylinder of said plurality of cylinders further comprises:

control means selectively operable to enable said fuel oil injector to inject fuel and to disable said fuel oil injector from injecting fuel;

passage means in said cylinder head having one end opening into said preselected cylinder;

an air line interconnecting said passage means with said compressed air reservoir;

check valve means disposed along said air line and operable to prevent the flow of air therealong from said compressed air reservoir to said preselected cylinder;

extra valve means along said passage means for selectively opening and closing said passage means;

hydraulic means for controlling the sequential opening and closing of said extra valve means in synchronism with the cycle of the other cylinders of said plurality of cylinders; and switching means selectively operable to disconnect and connect said hydraulic means and to enable and disable said fuel oil injector such that said switching means disconnects said hydraulic means and enables said fuel oil injector to operate said preselected cylinder as an engine cylinder and further such that said switching means connects said hydraulic means and disables said fuel oil injector to operate said preselected cylinder as a compressor cylinder.

15. The improvement of claim 14 wherein said hydraulic means further comprises:

a transmitting cylinder having a piston controlled by said timing means to selectively pressurize fluid in said transmitting cylinder during the period of time in said cycle of operation when combustion would have occurred in said preselected cylinder if said fuel oil injector is enabled; and receiving cylinder means hydraulically interconnected to said transmitting cylinder and mechanically interconnected with said extra valve means such as to selectively operate said extra valve means in response to the pressure level generated by said transmitting cylinder.

16. The improvement of claim 14 further comprising means for selectively opening said intake valve means of said preselected cylinder when said switching means connects said hydraulic means during the phase of said cycle of operation when combustion would occur in said preselected cylinder if said fuel oil injector were enabled.

17. The improvement of claim 14 further comprising:

hydraulic pump means;

fuel oil pump means;

manifold valve means having a first inlet, a second inlet, a first outlet, and a second outlet, said manifold valve means being selectively operable to interconnect said first inlet with said fist outlet and to interconnect said first inlet with said second outlet in response to the pressure level at said second inlet;

a first fuel oil line interconnecting said fuel oil pump means with said first inlet of said manifold valve means;

a second fuel oil line interconnecting said fuel oil injector with said first outlet of said manifold valve means;

a third fuel oil line interconnecting said low pressure fuel oil sink means with said second outlet of said manifold valve means;

a first hydraulic line interconnecting said hydraulic pump means with said low pressure hydraulic sink means;

first valve means along said first hydraulic line for selectively dosing said first hydraulic line in response to said switching means; and a second hydraulic line interconnecting said second inlet of said manifold valve means with a portion of said first hydraulic line between said hydraulic pump means and said first valve means such that, when said switching means opens said first valve means, the pressure at said second inlet is low and said manifold valve means interconnects said first inlet with said first outlet, thereby enabling said fuel oil injector, and when said switching means closes said first valve means, the pressure at said second inlet is high and said manifold valve means disconnects said fuel oil injector from said fuel oil pump means and disables said fuel oil injector.

18. The improvement of claim 14 further comprising:

a pressure detector measuring the pressure level in said compressed air reservoir and generating a first signal in response to said pressure level being measured below a predetermined minimum pressure level, said switching means disabling said fuel oil injector of said preselected cylinder and connecting said hydraulic means in response to said first signal.

19. The improvement of claim 18 further comprising deceleration detection means responsive to the motion of a vehicle containing said diesel piston engine, said deceleration detection means generating a second signal in response to the deceleration of said vehicle exceeding a predetermined level, said switching means responding to said first signal only when said second signal is generated.

20. The improvement of claim 14 wherein said hydraulic means for controlling the opening and closing of said extra valve means comprises:

sending cylinder means responsive to said timing means to generate an increased pressure level therein during the period of time in said cycle of operation when fuel oil would be injected into said preselected cylinder if said fuel oil injector is disabled; and receiving cylinder means responsive to said pressure level generated by said sending cylinder means to selectively operate said extra valve means in response to said pressure level exceeding a predetermined pressure level.

* * * * *

UNITED STATES PATENT AND TRADEMARK OFFICE

CERTIFICATE OF CORRECTION

PATENT NO. : 4,492,192

DATED : January 8, 1985

INVENTOR(S) : Yves Baguelin

It is certified that error appears in the above-identified patent and that said Letters Patent is hereby corrected as shown below:

Column 1, line 19, delete "pistion" and insert ---- piston ----.

Column 1, line 47, after "operating as" insert ---- a ----.

Column 2, line 43, delete "section".

Column 2, line 59, after "valves" insert ---- are ----.

Column 3, line 33, delete "46, and 47"" and insert ---- 46, and 51 ----.

Column 3, line 37, delete "The 51" and insert ---- The line 51 ----.

Column 3, line 61, before "detector 40" insert ---- pressure ----.

Column 4, line 6, before "valve 58" insert ---- distributing ----.

Column 5, line 60, delete "wth" and insert ---- with ----.

UNITED STATES PATENT AND TRADEMARK OFFICE

CERTIFICATE OF CORRECTION

PATENT NO. : 4,492,192

DATED : January 8, 1985

INVENTOR(S) : Yves Baguelin

It is certified that error appears in the above-identified patent and that said Letters Patent is hereby corrected as shown below:

Column 6, line 18, delete "respnse" and insert ---- response ----.

Column 7, line 59, delete "mean" and insert ---- means ----.

Signed and Sealed this

*Twenty-first* Day of *May 1985*

[SEAL]

*Attest:*

DONALD J. QUIGG

*Attesting Officer* *Acting Commissioner of Patents and Trademarks*